US006409066B1

(12) United States Patent
Schneider et al.

(10) Patent No.: US 6,409,066 B1
(45) Date of Patent: Jun. 25, 2002

(54) TOTE-BAG COOLER

(75) Inventors: Rachel Schneider; Terry A. Mears, both of Wichita, KS (US); James T. Sener, Glastonbury, CT (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/629,600

(22) Filed: Jul. 31, 2000

(51) Int. Cl.[7] ..... A45C 15/00

(52) U.S. Cl. ..... 224/585; 224/148.4; 224/236; 224/250; 224/275; 224/578; 224/579; 224/610; 224/680; 224/681; 190/110; 190/112; 190/115; 190/125; 206/545; 220/592.1; 220/524; 220/254; 220/915.2; 383/40; 383/41; 383/43; 383/99

(58) Field of Search ..... 224/148.1, 148.3, 224/148.4, 578, 579, 580, 585, 602, 603, 610, 611, 620, 621, 622, 680, 681, 682, 236, 237, 241, 249, 250, 275, 572, 926; 190/107, 108, 110, 112, 115, 125; 206/541, 545, 546; 220/592.1, 592.17, 524, 525, 530, 254

(56) References Cited

U.S. PATENT DOCUMENTS 4,246,945 A * 1/1981 Sterling ..... 150/51
4,350,274 A * 9/1982 Morgan ..... 224/205
4,461,030 A * 7/1984 Knudsen ..... 224/222
D340,840 S * 11/1993 Melk ..... D7/607
5,505,307 A * 4/1996 Shink ..... 206/541
5,558,440 A * 9/1996 Miller ..... 383/87
D375,835 S * 11/1996 Christopher et al. ..... D3/289
D382,771 S * 8/1997 Mogil ..... D7/607
5,749,447 A * 5/1998 Hersh et al. ..... 190/112
5,924,303 A * 7/1999 Hodosh ..... 62/457.4
5,988,468 A * 11/1999 Murdoch et al. ..... 224/237
6,234,677 B1 * 5/2001 Mogil ..... 383/110

* cited by examiner

*Primary Examiner*—Stephen K. Cronin
(74) *Attorney, Agent, or Firm*—Kramer, Levin, Naftalis & Frankel LLP

(57) ABSTRACT

A tote-bag cooler includes a multi-chambered, closeable container enclosed by overlapping flaps creating a self-sealing, sleeve-style aperture. Handle straps may be attached to the sides of the container. A handle grip may be attached to the mid-section of one of the handle straps and may be wrapped around the opposing handle strap when grasping the handle straps. A shoulder strap may be included also. The outer surface of the container optionally may include a beverage holder, a seat belt strap, mesh pockets, and/or a fabric pocket.

20 Claims, 15 Drawing Sheets

TOTE-BAG COOLER

FIELD OF THE INVENTION

The present invention relates to portable, insulated, carrying devices useful for storing, conveying and serving food and beverages, and more specifically to insulated, soft-sided, tote-bag coolers.

BACKGROUND INFORMATION

Simple, portable, hard-walled coolers formed of metal or plastic and designed solely to maintain food and beverages at low temperatures are well known in the art. For example, hard-sided, insulated containers, such as coolers and jugs, are manufactured in a variety of shapes and sizes by The Coleman Company of Wichita, Kans. Lightweight, soft-sided coolers that serve similar functions are also known in the art, a variety of which are also manufactured by The Coleman Company.

It would be desirable that lightweight, soft-sided coolers serve additional functions as well as, such as cooling food and beverage containers while allowing for fast and easy retrieval. A tote-bag cooler having an insulated chamber accessible by a self-sealing, sleeve-style aperture would permit fast and easy retrieval of the chamber's contents. Additionally, a tote-bag cooler modified by a beverage holder could securely hold a beverage receptacle for ready pouring or consumption of a beverage. Such coolers would make more convenient the conveyance of food, beverages, and utensils to outdoor events such as beach outings, barbecues, picnics and football games, and at the same time would provide convenient, one-handed access to the food and beverage containers.

Another desirable feature is the ability to secure such a cooler to the seat of a car, van or truck to during transport of the cooler. Secured placement of the cooler in a vehicle may reduce the risk of spillage or overturning of the cooler's contents during routine driving maneuvers.

It therefore would be advantageous to design an insulated bag as a soft-sided cooler in which food and beverages may be cooled, but which also could facilitate easy access and retrieval of the food and beverages without opening one of the zippered chambers. Such a multi-functional tote-bag cooler could facilitate consumption of the food and beverages by the user.

SUMMARY OF THE INVENTION

The present invention relates to portable, insulated, carrying devices useful for storing, conveying and serving food and beverages, and more specifically to insulated, soft-sided, tote-bag coolers. A tote-bag cooler may store, convey and serve food and beverages.

A tote-bag cooler may include, for example, handle straps, a closeable handle grip, and a multi-chambered, closeable container having an insulated, soft-sided inner surface and a rugged-fabric, flexible outer surface construction. The tote-bag cooler may be constructed in part, for example, of an insulating material and a liner shaped to fit the interior so as to form one or more storage chambers.

The multi-chambered, closeable container may include opposing side chambers separated by two interior walls delimiting a center chamber. The opposing side chambers may include a vertical sidewall sealed to a bottom side and enclosed by lids having zipper enclosures. The center chamber may include vertical interior walls sealed to the bottom side and enclosed by overlapping flaps extending inward from the-lids, creating a self-sealing, sleeve-style aperture.

A tote-bag cooler may be carried by hand or shoulder. Handle straps may allow for ease of conveyance by hand, while the use of a shoulder strap may free the user's hands for other purposes. The handle straps may be attached to the sides of the container, forming two loops along the length of the container. The two loops of the handle straps may meet above the center of the container when the two loops of the handle straps are grasped to carry the container. The handle grip may be attached to the mid-section of one of the handle straps and may be wrapped around the opposing handle strap when grasping the handle straps.

A tote-bag cooler may be designed to facilitate easy access to beverage containers. In addition to easy access to a beverage container within the center chamber via the sleeve-style aperture, another embodiment of the present invention may provide a hinged beverage holder for fast access to beverage receptacles. A beverage holder may be secured to the outer surface of the tote-bag cooler.

A tote-bag cooler also may be designed to hold small items in a convenient manner. Such a tote-bag cooler therefore may include, for example, mesh that may be fixedly secured to the outer surface of the tote-bag cooler. Small items may be held between the mesh and the outer surface of the cooler. A fabric pocket having a secure closure may be included as well to hold small, more valuable items, like keys. Additionally, small or narrow items also may be placed in open gaps formed by folds in strap supports that support the handle and shoulder straps. Gaps arise where the strap supports may be intermittently attached to the outer surface of the sidewall.

A tote-bag cooler also may be designed so as to reduce cooler movement during transport in an automotive vehicle. To that end, a tote-bag cooler also may include a seat belt strap for securing the cooler to a vehicle seat. Such an embodiment may include, for example, a tether portion which may be secured to the outer surface of a sidewall or the bottom side of the cooler, and which when held by a seat belt may maintain the cooler securely on the vehicle seat.

BRIEF DESCRIPTION OF THE DRAWINGS

FIGS. 1A–1B respectively are perspective and cut-away views of an exemplary tote-bag cooler according to an embodiment of the present invention, whereas

Figure 1A:
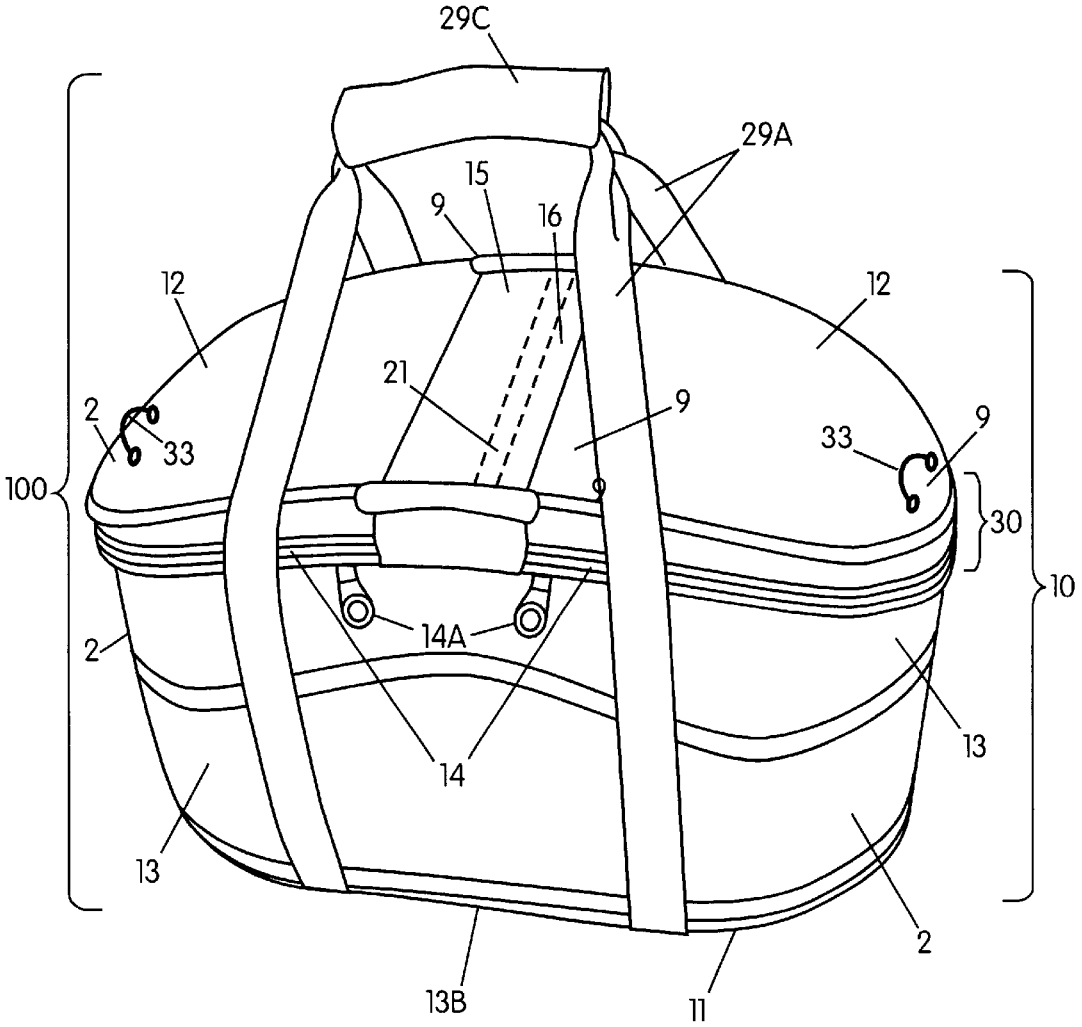

Other features and advantages of the present invention will be apparent from the following description of the exemplary embodiments thereof, and from the claims.

DETAILED DESCRIPTION

FIGS. 1, 2, 3 and 4, illustrate an exemplary embodiment of a tote-bag cooler 100. Tote bag cooler 100 may include handle straps 29A, a closeable handle grip 29C, and a multi-chambered, closeable container 10 having an insulated, soft-sided inner surface 1 and a rugged-fabric, flexible outer surface 2 construction. The multi-chambered, closeable container 10 may include opposing side chambers 18B separated by two interior walls 19 delimiting a center chamber 18A. Each opposing side chamber 18B may include a vertical sidewall 13 sealed at a bottom edge 13B to a bottom side 11 and enclosed by a top side 9 having a lid 12 attached by, for example, zipper enclosures 14. The center chamber 18A may include vertical interior walls 19 sealed to the bottom side 11 and enclosed by overlapping flaps 15, 16 extending inward from the lids 12, creating a self-sealing, sleeve-style aperture. The handle straps 29A may be attached to the sides of the container 10, forming two loops along the length of the container 10. The two loops of the handle straps 29A meet above the center of the container 10 when the two loops of the handle straps 29A are grasped to carry the container 10. The handle grip 29C may be attached to the mid-section of one of the handle straps 29A and may be wrapped around the opposing handle strap when grasping the handle straps 29A.

The bottom side 11, lid 12 and sidewall 13 each may have, for example, an outer surface 2, such as durable woven nylon, and an inner surface 1, such as PVC, a smooth nylon (e.g., wipe clean surface 210 denier nylon) or flexible plastic material. Accordingly, the cooler 100 may be flexible and easily deformed (e.g., folded or flattened) for convenient storage. A thermally insulating material 3 may be disposed adjacent the inner surface 1 and joined together, for example, by an attachment at their respective adjacent edges. A liner 17 (not shown) may be shaped to fit interiorly within the bottom side 11, lid 12 and vertical sidewall 13 and over the thermally insulated material. Liner 17 may be fixedly attached to, for example, the inner surface 1, e.g., at the top edge 13A of the vertical sidewall 13, so as to cover the inner surface 1 of the sidewall 13, bottom side 11 and lid 12, and thereby to form an insulated food storage chamber 18. The lid 12 may be, for example, hingedly mounted to a top side 9 or a portion of the sidewall 13, and may be moveable between an open position and a closed position. The lid 12 covers the food storage chamber 18 when in the closed position, for example making a sealing connection with the vertical sidewall 13 by zipper 14.

The center chamber 18A may be enclosed, for example, by overlapping flaps 15, 16 extending inward from the lids 12 to create a self-sealing, sleeve-style aperture. The overlapping flaps 15, 16 may include a top flap 15 and a bottom flap 16. The overlapping flaps 15, 16 may be approximately of equal size and may overlap each other by about half their widths. The overlapping flaps 15, 16 may be attached in an overlapping fashion to the top side 9 of the container 10 so that top flap 15 and the bottom flap 16 rest in substantial contact with each other. As shown in FIG. 1C, the container 10 may have a second set of overlapping flaps 15*a,* 16*a* corresponding to a second aperture providing access to an additional chamber 18C.

When in substantial contact with each other, the overlapping flaps 15, 16 may act as a self-sealing enclosure. When the overlapping flaps 15, 16 are held apart from one another, they may create a sleeve-style aperture that may permit easy access to the contents of the center chamber 18A. The overlapping flaps 15, 16 may be made of, for example, soft, insulating materials, such as fabric-covered neoprene, that are comfortable to touch and help to insulate the center chamber 18A. Using only one hand, a user could reach between the overlapping flaps 15, 16, grasp the contents of the center chamber 18A, remove them, and allow the overlapping flaps 15, 16 to close once the contents are free of the container 10. This one-handed, quick-in/quick-out manner of removing contents from the cooler retains the cool air within chamber 18A, keeping chamber 18A cool longer.

For added security and insulation of the center chamber 18A, the overlapping flaps 15, 16 may have an additional closure mechanism 21. The additional closure mechanism 21 may assist in keeping the overlapping flaps 15, 16 in substantial contact with each other, so as to provide a more stable seal. The top flap 15 and bottom flap 16 may include complementary, interlocking components of the additional closure mechanism 21, such as VELCRO® strips, snaps, zipper tracks, hooks, or buckles. Alternatively, for example, thin, flat, flexible strips of metal or plastic may be woven into the overlapping flaps 15, 16 at the overlap, whereupon the flat strips could bow outward when the overlapping flaps 15, 16 are separated and then flex back to a flat, closed position when the flaps are released.

In addition to or instead of the above additional closure mechanisms 21, an outer flap 22 (shown in FIG. 4B) may be attached to the container 10 and cover the overlapping flaps 15, 16. The outer flap 22 could be releasably fastened to the perimeter of the overlapping flaps 15, 16, such as by a zipper 22A, during transport or when access to the center chamber 18A is not required for extended periods. When access to the center chamber 18A is desired, the outer flap 22 may then be unfastened and stowed, such as by rolling it up and/or attaching it to the outer surface 2 of the container 10.

The tote-bag cooler 100 also may include, for example, a beverage holder 23 hingedly secured to a sidewall 13 and adapted to move between a stable closed position and a stable open position. The beverage holder 23 may include, for example, a stiff flat sheet 24, a support device 26 for fixedly securing the stiff flat sheet 24 in the stable open position and a closure device 25 for fixedly securing the stiff flat sheet 24 in the stable closed position (see FIG. 3C). The stiff flat sheet 24 may be disposed, for example, between fabric material such as the same material used for the outer surface 2 of the sidewall 13 and may include, for example, at least one cut-out ring 27 having a diameter sized to hold a pre-selected beverage container 28.

The flat sheet 24 of beverage holder 23 may be positioned vertically in the stable closed position so as to be, for example, substantially flush with the sidewall 13, and may be positioned horizontally in the stable open position so as to be, for example, substantially perpendicular to the sidewall 13. Support device 26 for fixedly securing the flat sheets in a stable open position may include, for example, a nylon, leather, vinyl, or leatherette cord or strap, or other suitable material. Closure device 25 may include for example, VELCRO® hook-and-loop strips, a button, snaps or other suitable fastening mechanism. The beverage holder 23 may include one or more parallel flat sheets of stiff material. For example, when only one flat sheet is employed, the can or cup fits in the cut-out ring 27, hanging stably therefrom. Alternatively, two flat sheets may be employed and thus the can or cup fits in the cut-out ring 27 of an upper flat sheet 24A and the bottom of the can or cup rests on a lower flat sheet 24B.

The tote-bag cooler 100 according to an additional embodiment of the present invention may further include, for example, carrying device 29 for holding or carrying the portable cooler 100. For example, carrying device 29 may include handle straps 29A on opposing ends of portable cooler 100 and/or a shoulder strap 29B, as shown in FIG. 3C. Handle straps 29A may be integrally formed with or separately attached to the strap supports 38 attached to the sidewall 13. Alternatively, carrying device 29 could include the adjustable straps 40 illustrated in FIGS. 5–7 and described below.

In an exemplary embodiment of the portable cooler 100, the bottom side 11, lid 12 and sidewall 13 may be soft, flexible and deformable. Accordingly, when the cooler 100 is not in use, it may be folded or otherwise minimized for ease of storage. Similarly, when in use, the cooler 100 may be easily manipulated (e.g., mildly deformed as needed). For example, the bottom side 11, lid 12 and sidewall 13 may be exteriorly covered by a material or fabric such as a waterproof textile, plasticized cloth, 210 denier nylon, vinyl, leather or leatherette, or a combination thereof. The covering also may be nylon with a vinyl trim. The insulating material 3 may include sheets fabricated from any polymer with suitable insulating and tactile properties such as plastic foam of types well-known in the art. One specific material may be polyurethane foam. The liner 17 material may include, for example, a conventional plastic liner suitable for use with food products.

In an exemplary embodiment of the portable cooler 100, the lid 12 further comprises at least one enclosure mechanism 30. The lid 12 may be maintained in the stable closed position by enclosure mechanism 30, either semi-permanently so as to require an unlocking step or transiently so as to require a simple displacement to open the lid 12. Enclosure mechanism 30 may include a VELCRO®-type closure having a suitably sized and shaped fastener portion 31 and complementary fastener portion 32, one being fixedly attached interiorly to the lid 12 and the other being fixedly attached exteriorly to the top edge 13A of the sidewall 13 opposite the hinged mounting of the lid 12. This design serves to maintain the lid 12 transiently in the stable closed position. The fastener portion 31 may include a VELCRO®-type hook segment and the complementary fastener portion 32 may include a VELCRO®-type loop segment, or vice-versa. The fastener portion and complementary fastener portion may be attached to the lid 12 or sidewall 13 by any method known in the art, but preferably using plastic or metal rivets, stitching or adhesive.

Alternatively, the enclosure mechanism 30 may include a zipper assembly 14 positioned substantially along the top edge 13A of the sidewall 13 so as to maintain the lid 12 semi-permanently in a stable closed position. In an exemplary embodiment, the zipper assembly 14 may be of the parallel double-zipper type, wherein two zipper heads 14A are attached by a cord and ride along two parallel zipper tracks 14B running on opposite sides of the lid 12, thereby allowing rapid single-motion zipping and unzipping by pulling the cord. Alternatively, in another exemplary embodiment, one zipper track 14B having two opposing zipper heads 14A may run along the perimeter of the lid 12 and the top edge 13A, allowing the zipper 14 to be opened anywhere along the length of the zipper track 14B to permit longer items to stick out if necessary.

Figure 1B:
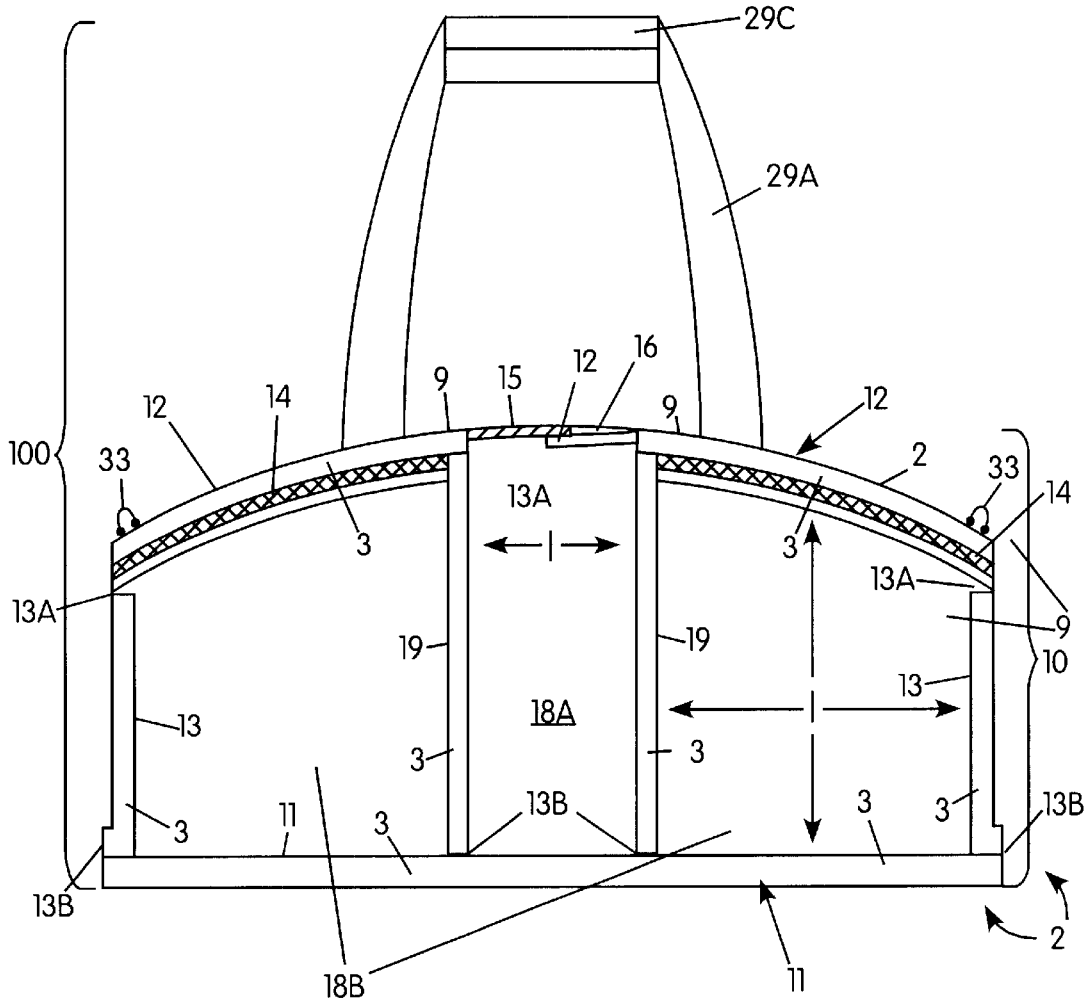
Figure 1C:
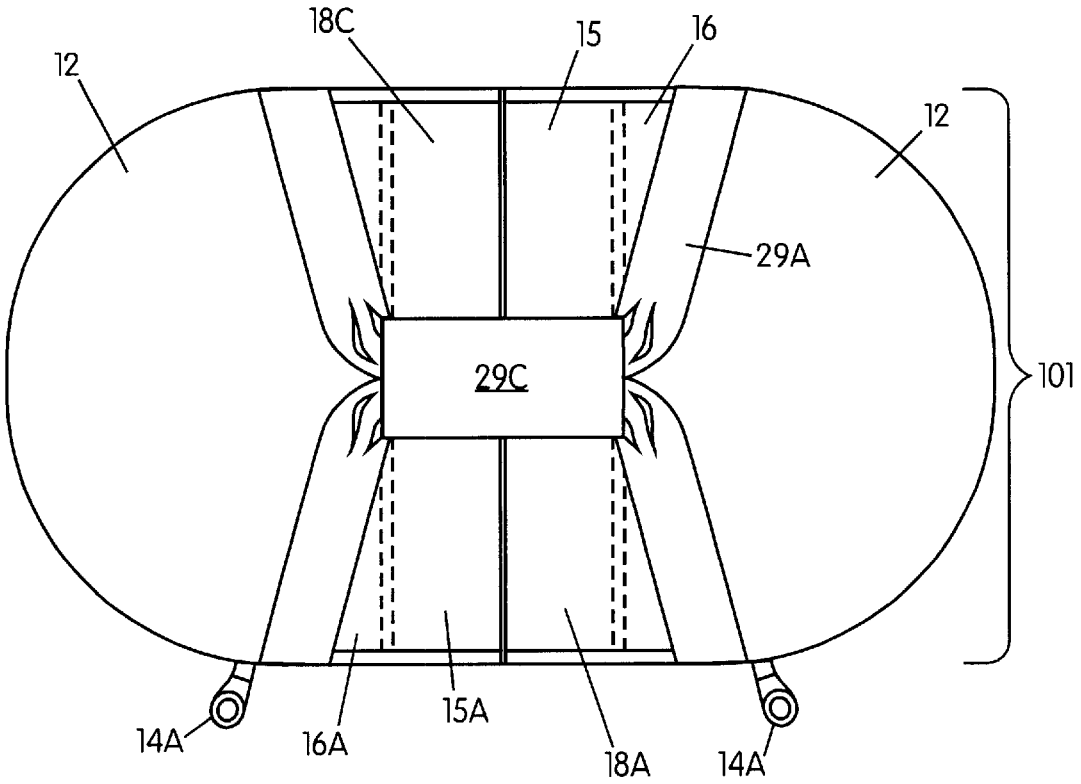
FIG. 1C is a top plan view of an exemplary tote-bag cooler according to an embodiment of the present invention having two sleeve-style apertures.

As illustrated in FIGS. 1 and 2, the lid 12 may have a lid handle 33 positioned on the outer surface 2 thereof opposite to the hinged mount of the lid 12. The lid handle 33 may be a loop of material or a piece of fabric attached to the lid 12. The fabric or material may be any suited to the purpose known in the art, and preferably, may be nylon, leather or plastic cord, or a metal piece. Similarly, the beverage holder 23 each may have a beverage holder handle 35 of like construction.

Figure 8:
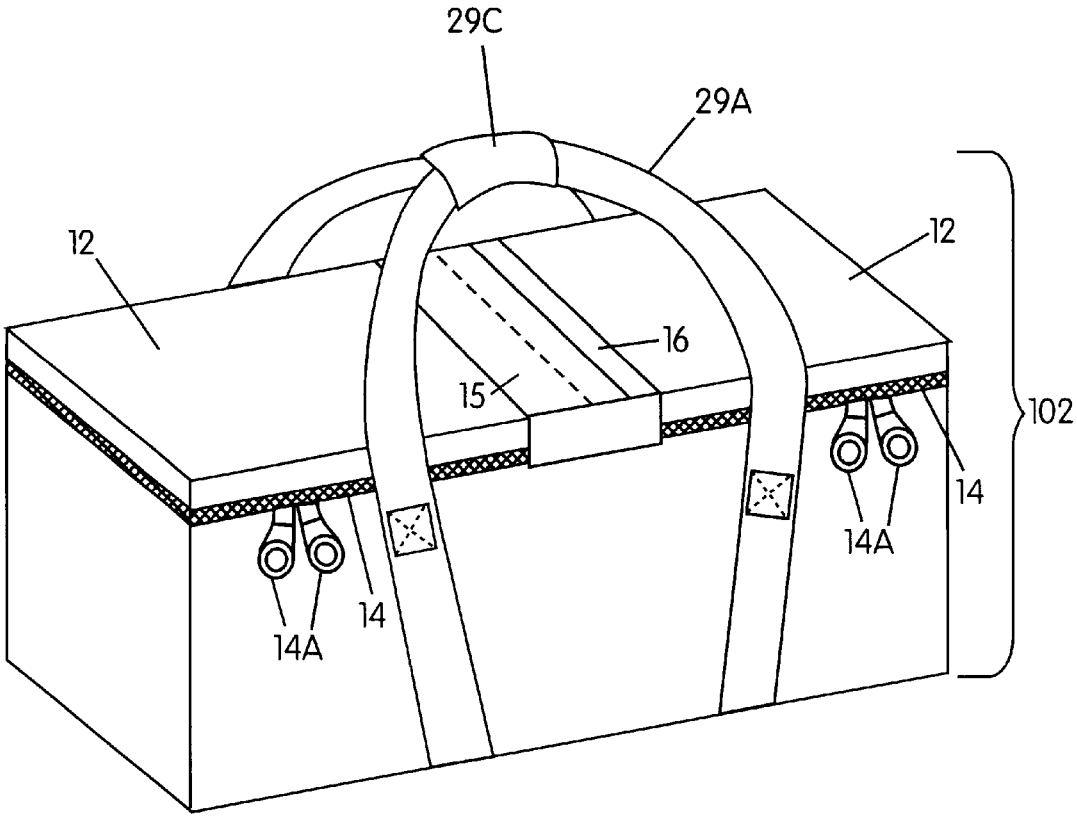
FIG. 8 is a perspective view of an exemplary tote-bag cooler according an embodiment of the present invention having a rectilinear orientation.
Figure 9:
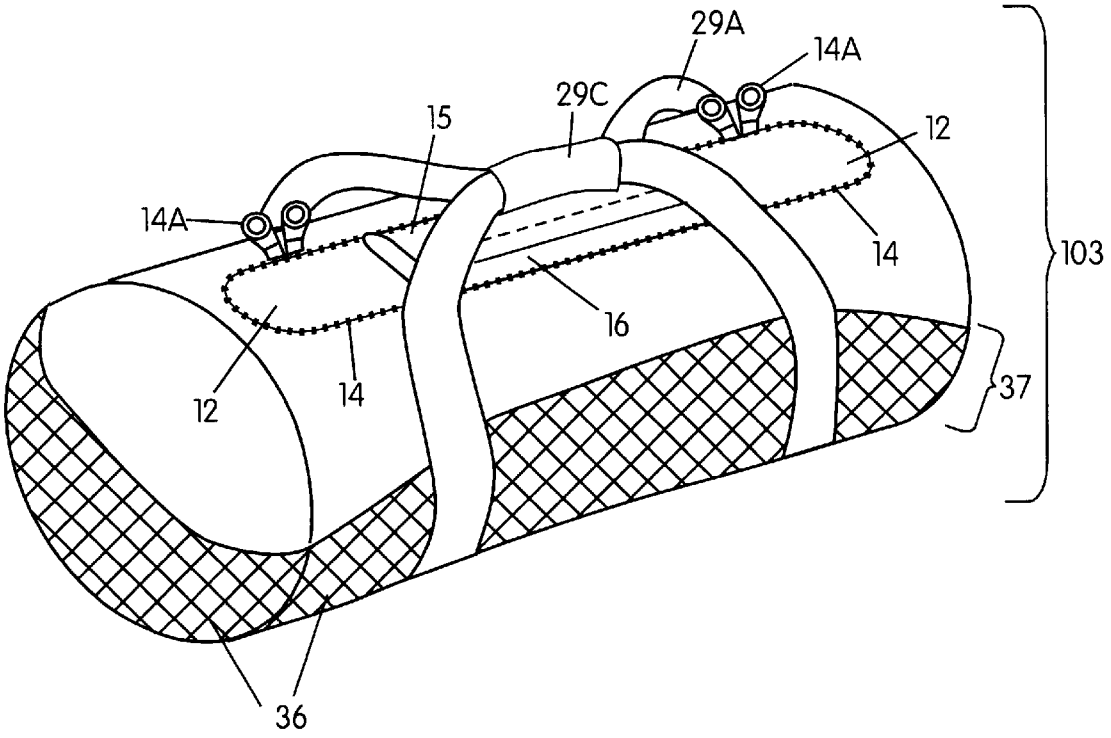
FIG. 9 is a perspective view of an exemplary tote-bag cooler according an embodiment of the present invention having a cylindrical orientation.

The sidewall 13 of portable cooler 100 may be arranged, for example, in a substantially curvilinear fashion, as in the ovally-shaped embodiments 101 of cooler 100 shown in FIGS. 1–7. Other orientations (e.g., rectilinear embodiment 102, shown in FIG. 8, and cylindrical embodiment 103, shown in FIG. 9) also may be encompassed by the present invention. The attachment of the bottom-side 11, lid 12, top side 9, and sidewall 13 may be by any means known in the art suited for the purpose, such as sewn stitching, heat sealing, stapling or integral construction.

The stiff flat sheet 24 may be fabricated from a variety of suitable materials all well known in the art, such as high-density plastic sheeting or cardboard, and may be preferably made from polyethylene or polypropylene board.

In an exemplary embodiment of the present invention, the beverage holder 23 may include two cut-out rings 27. The cut-out rings 27 may be sized, for example, to fit commercially available bottle, cup or can sizes, and commonly may have a diameter of about 2 inches to about 4 inches. Preferably, the cut-out rings 27 may have a diameter of about 2.5 inches.

Figure 4A:
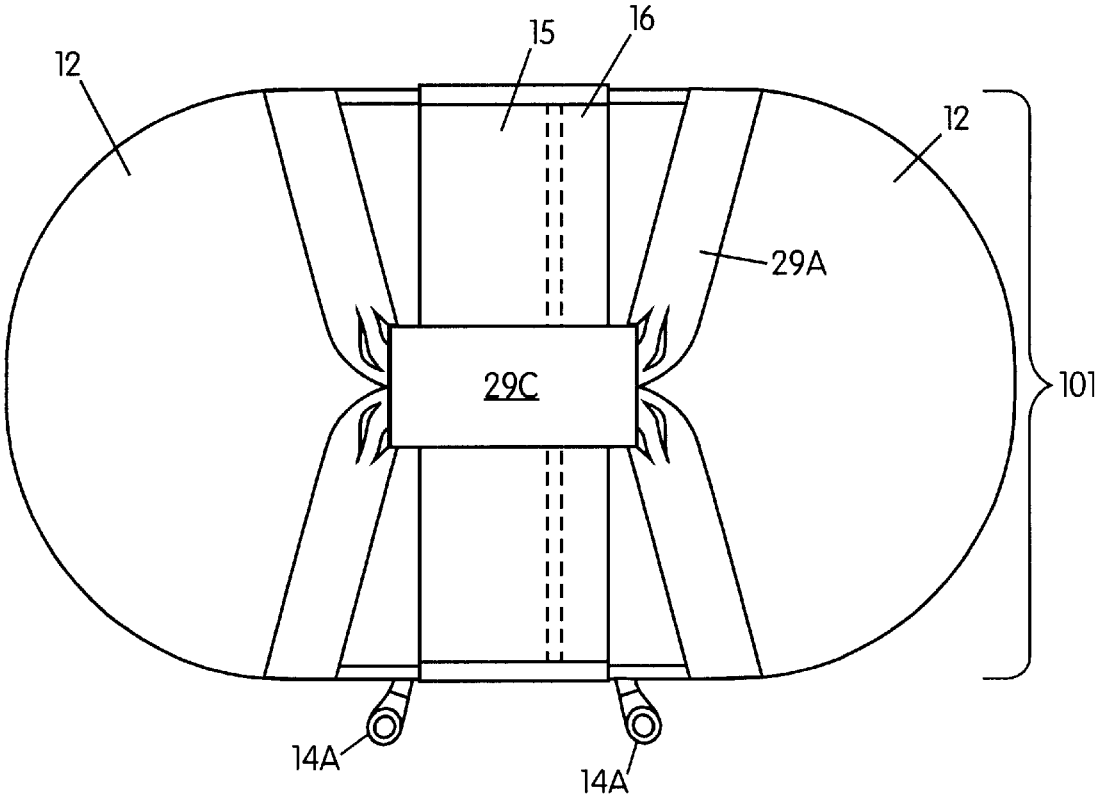
FIGS. 4A–4B respectively are top views of exemplary tote-bag coolers according to other embodiments of the present invention.
Figure 4B:
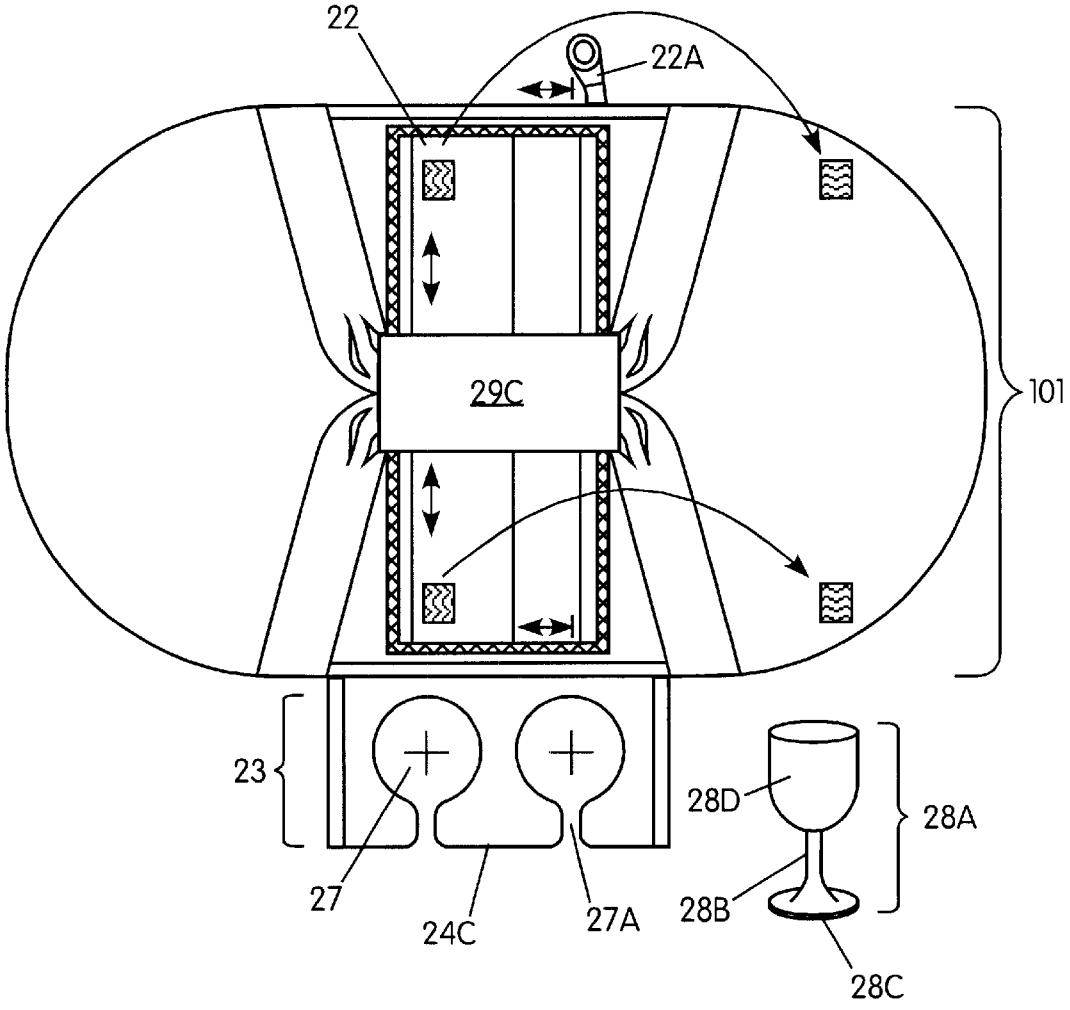

In another exemplary embodiment, beverage holder 23 may be designed to hold a stemware vessel 28A, such as, for example, wine goblet, having a stem 28B, a foot 28C, and a bowl 28D. As shown in FIG. 4B, A cut-out ring 27 may include a slot 27A through which stem 28A may be passed, and the stemware vessel 28A may be lowered into cut-out ring 27. The bowl 28D of stemware vessel 28A may rest against cut-out ring 27, suspending stemware vessel 28A in the beverage holder 23. For additional strength, stiff flat sheet 24 may include, or be substituted with, wire piping 24C outlining sheet 24, cut-out ring 27 and slot 27A.

Figure 3A:
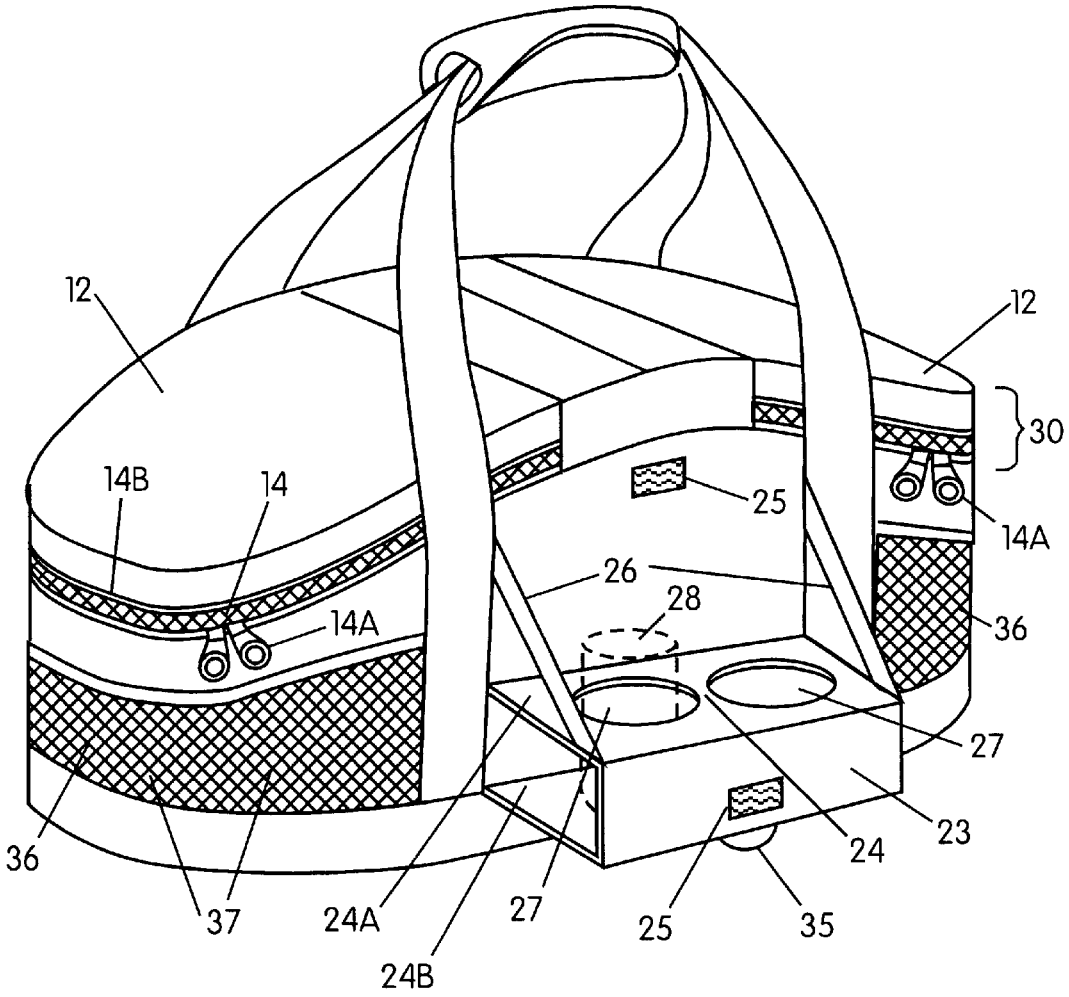
FIGS. 3A–3C respectively are perspective, end, and front views of an exemplary tote-bag cooler according to another embodiment of the present invention, including a view of a mesh pocket for holding small items, and a view of a beverage holder, in an open position in FIGS. 3A–3B and in a closed position in FIG. 3C.
Figure 3B:
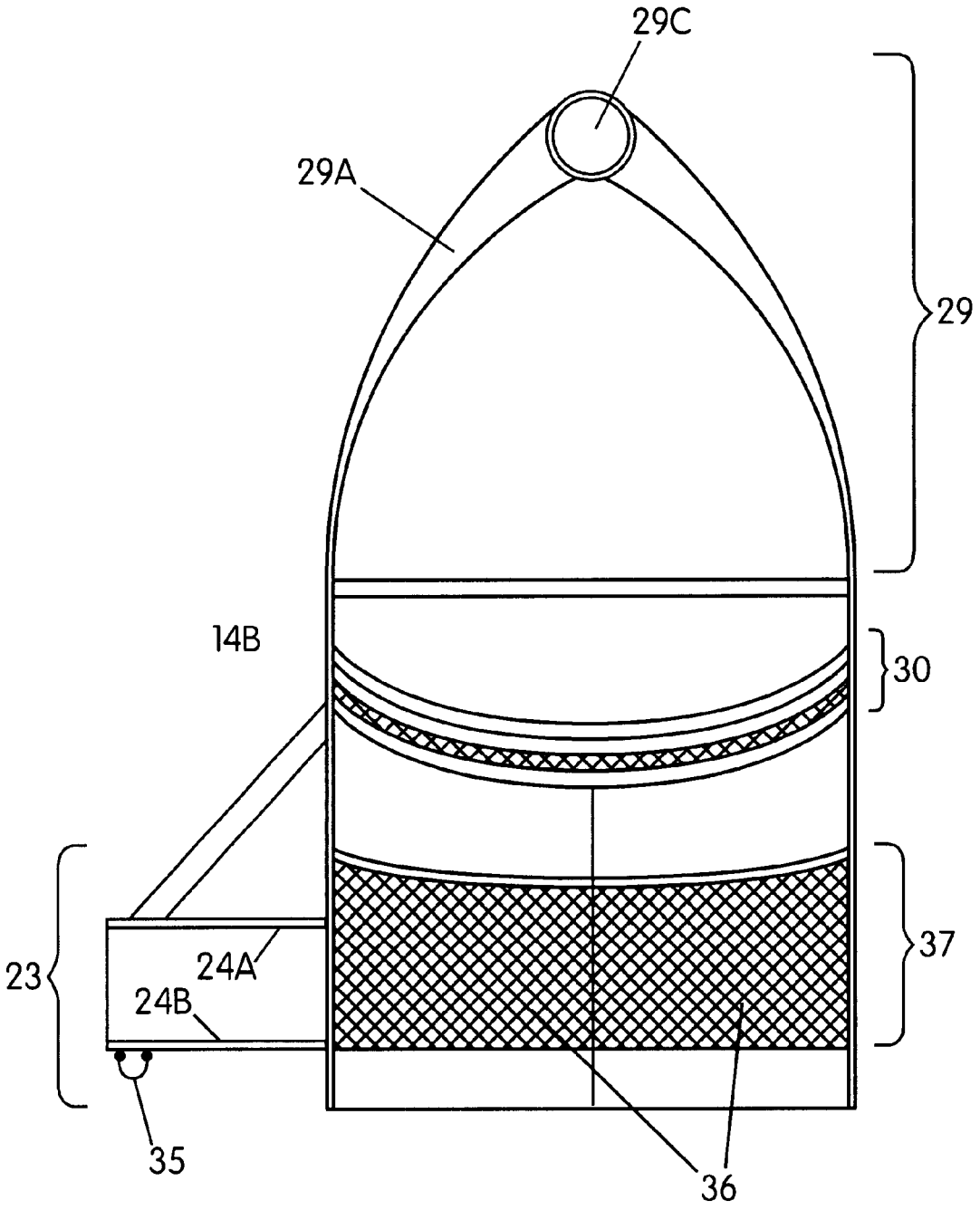
Figure 3C:
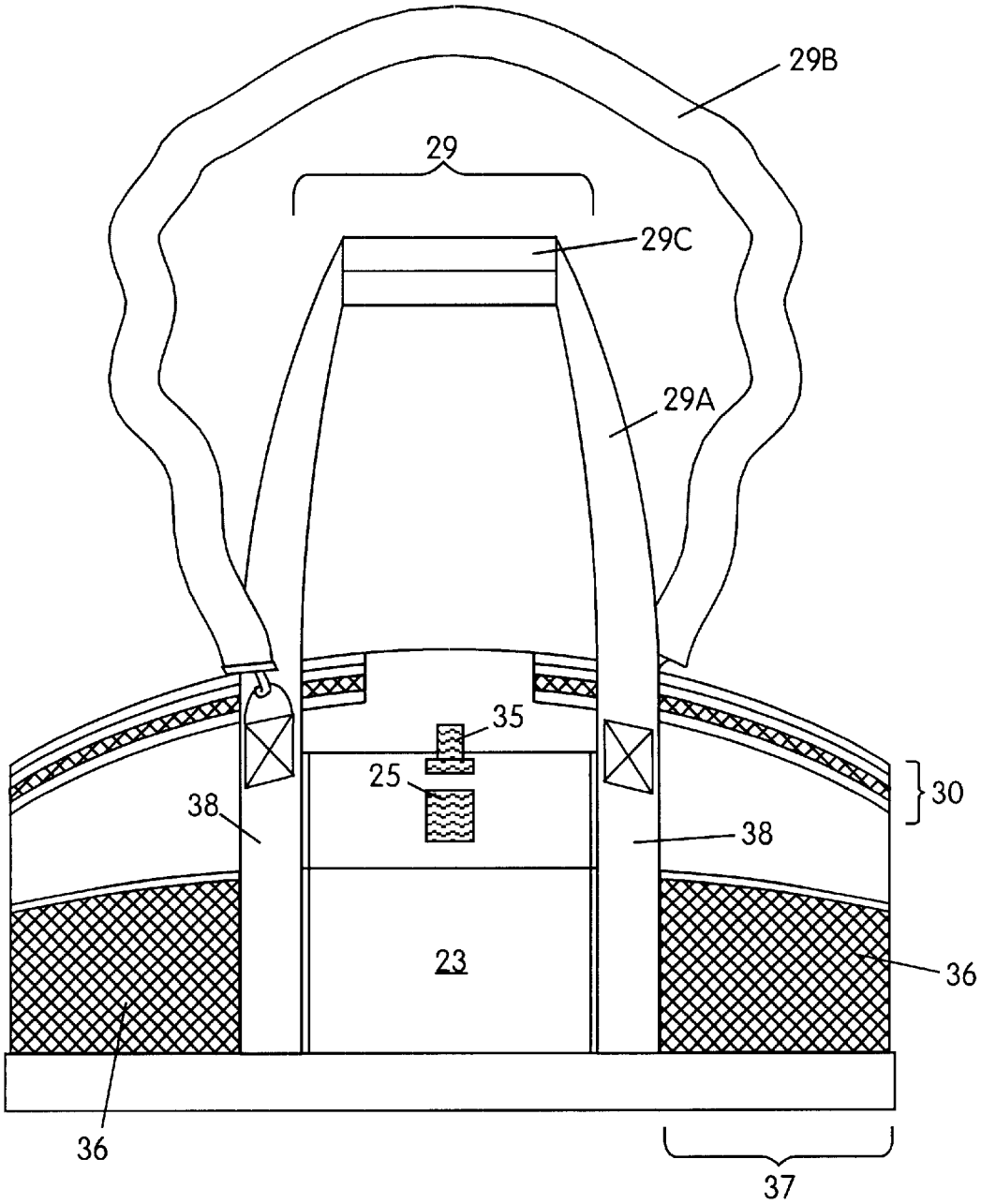

In an exemplary embodiment, the present invention also may include at least one-mesh pocket 36 suitable for holding small items (shown in FIGS. 3A–3C). The mesh pocket 36 may be, for example, fixedly attached to the outer surface 2 of a sidewall 13 and adapted to open a sufficient amount to receive and support small items between the outer surface 2 and mesh pocket material 37. The pocket 36 may include, for example, a suitably-shaped mesh material 37 positioned vertically so as to be substantially flush with the sidewall 13 and capable of expanding outward from the sidewall 13 when mesh pocket 36 may be in use.

The mesh pocket 36 may be positioned anywhere desired on a sidewall 13, such as substantially lengthwise along a curve of a sidewall 13. The suitably shaped mesh material 37 may be made of various materials known in the art such as woven nylon or plasticized cloth.

Figure 2A:
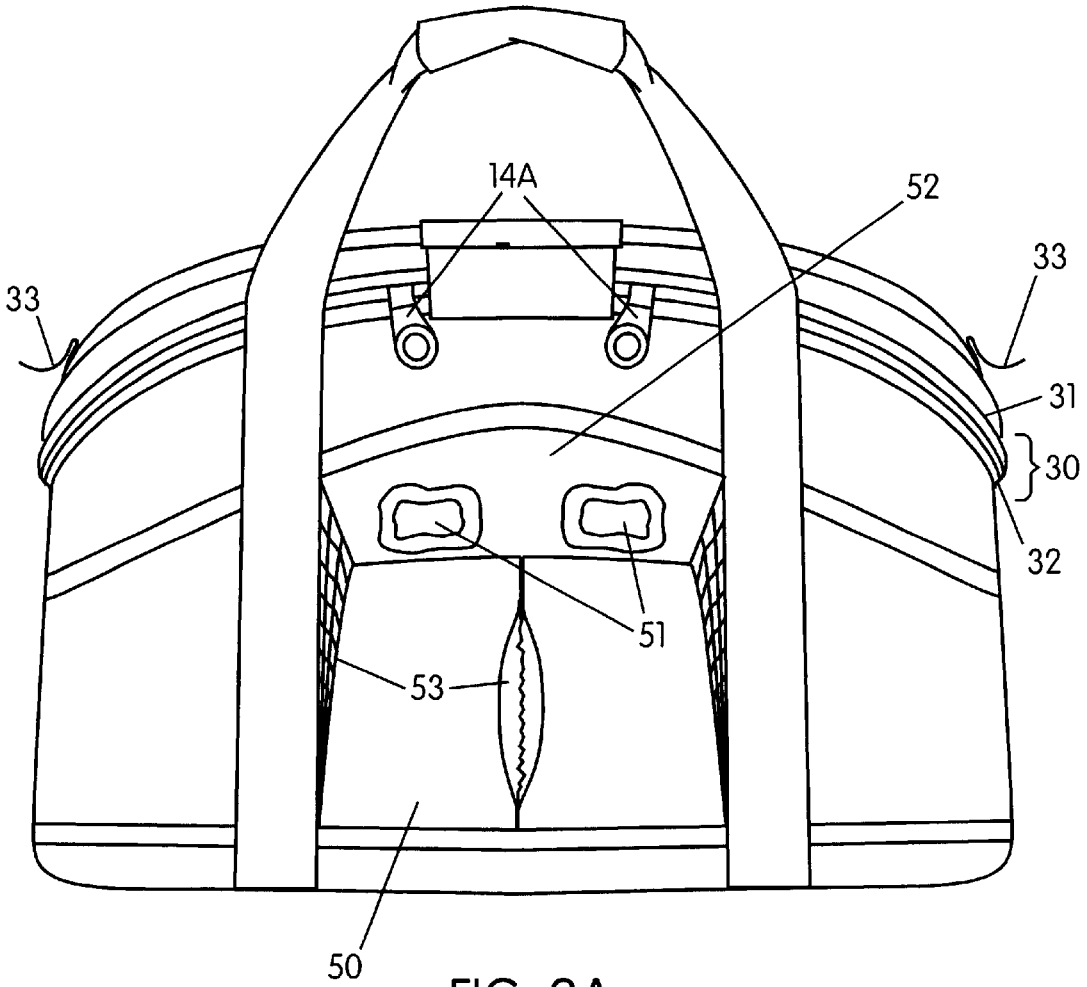
FIGS. 2A–2B respectively are front and back views of an exemplary tote-bag cooler according to an embodiment of the present invention.
Figure 2B:
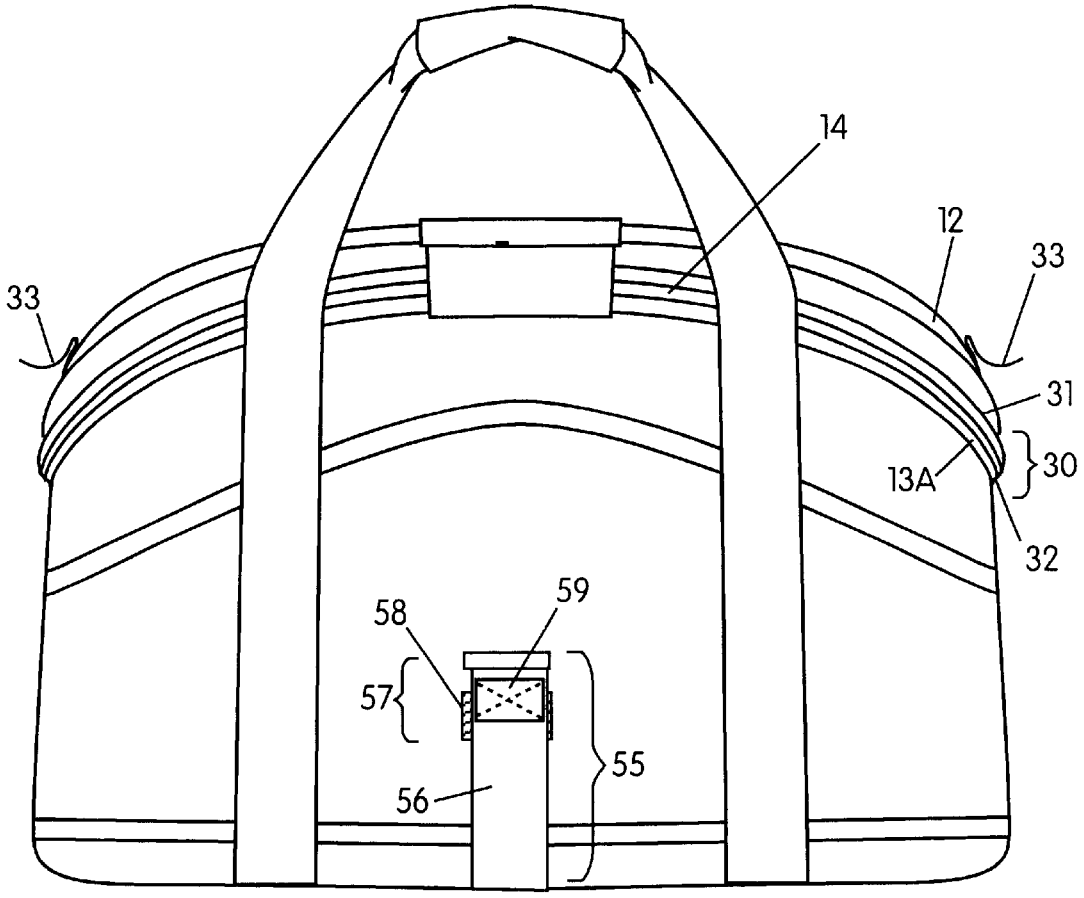

In another exemplary embodiment, the tote-bag cooler 100 further may include a fabric pocket 50, which may be attached, for example, to the outer surface 2 of sidewall 13 (shown in FIG. 2A). Similar to mesh pocket 36, the fabric pocket 50 also may hold small items. Fabric pocket 50 may be include gussets 53 for increased pocket capacity, if desired. Moreover, fabric pocket 50 may include, for example, a closure mechanism 51 to secure the opening of the fabric pocket 50 to the outer surface 2 of a sidewall 13. The closure mechanism 51 (shown exposed in FIG. 2A) may include, for example, a zipper, snaps, VELCRO® strips, or the like, with or without a flap 52 covering the opening. Use of the closure mechanism 51 may reduce the risk that small valuables such as coins or keys may inadvertently come out of the fabric pocket 50.

The tote-bag cooler 100 may further include, for example, a seat belt strap 55 (shown in FIG. 2B) for securing the cooler 100 to a vehicle seat(not shown). The seat belt strap 55 may include, for example, a tether portion 56 which may be attached to the outer surface 2 of a sidewall 13 or to the bottom side 11 and may be adapted to open and close with respect to the outer surface 2 to receive a seat belt (not shown). The seat belt strap 55 further may include, for example, fastening mechanism 57 for securing the tether portion 56 in the closed position, such as VELCRO®, hooks, snaps, buttons or other suitable fastening mechanism.

Fastening mechanism 57 for fixedly securing the tether portion 56 in the closed position may include, for example, a fastener portion 58 and a complementary fastener portion 59, which may be attached respectively to the tether portion and the sidewall 13, or vice-versa. The fastener portion 58 preferably may include a VELCRO®-type hook segment and the complementary fastener portion 59 preferably may include a VELCRO®-type loop segment, located on the sidewall 13 adjacent to the fixed securement of the tether portion 56 such that the tether portion 56 may be flush with the sidewall 13 in the closed position. The tether portion 56, the fastener portion 58 and the complementary fastener portion 59 may be each attached to the sidewall 13 or bottom side 11 by means known in the art, such as with plastic or metal rivets, stitching or adhesive. The tether portion 56 may be suitably dimensioned so as to maintain the cooler 100 securely on the automotive vehicle seat (not shown).

Figure 5:
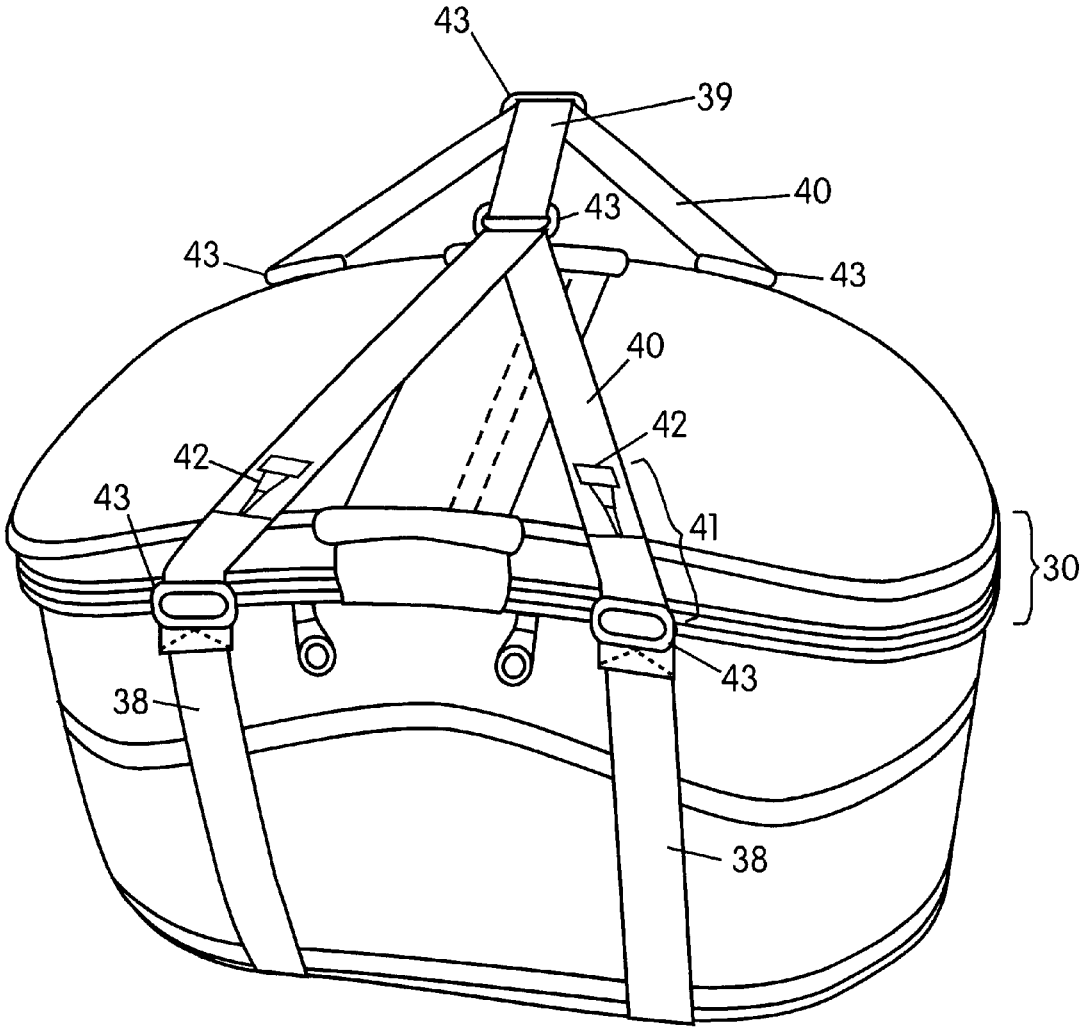
FIG. 5 is a perspective view of an exemplary tote-bag cooler according an embodiment of the present invention, including a view of adjustable carrying straps in a handle position.
Figure 6:
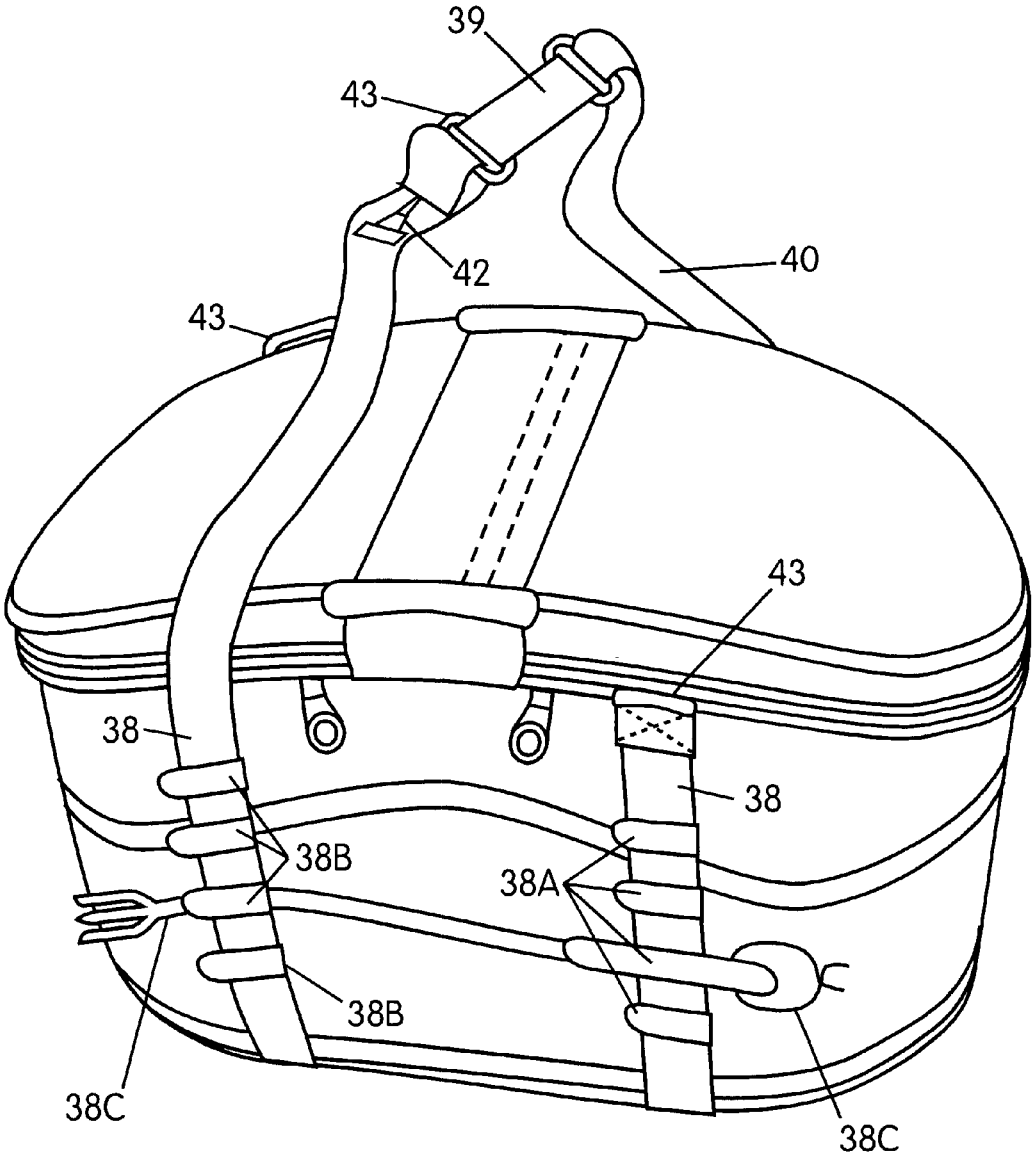
FIG. 6 is a perspective view of an exemplary tote-bag cooler according an embodiment of the present invention, including a view of adjustable carrying straps in a shoulder strap position, and a view of folds made in strap supports.
Figure 7:
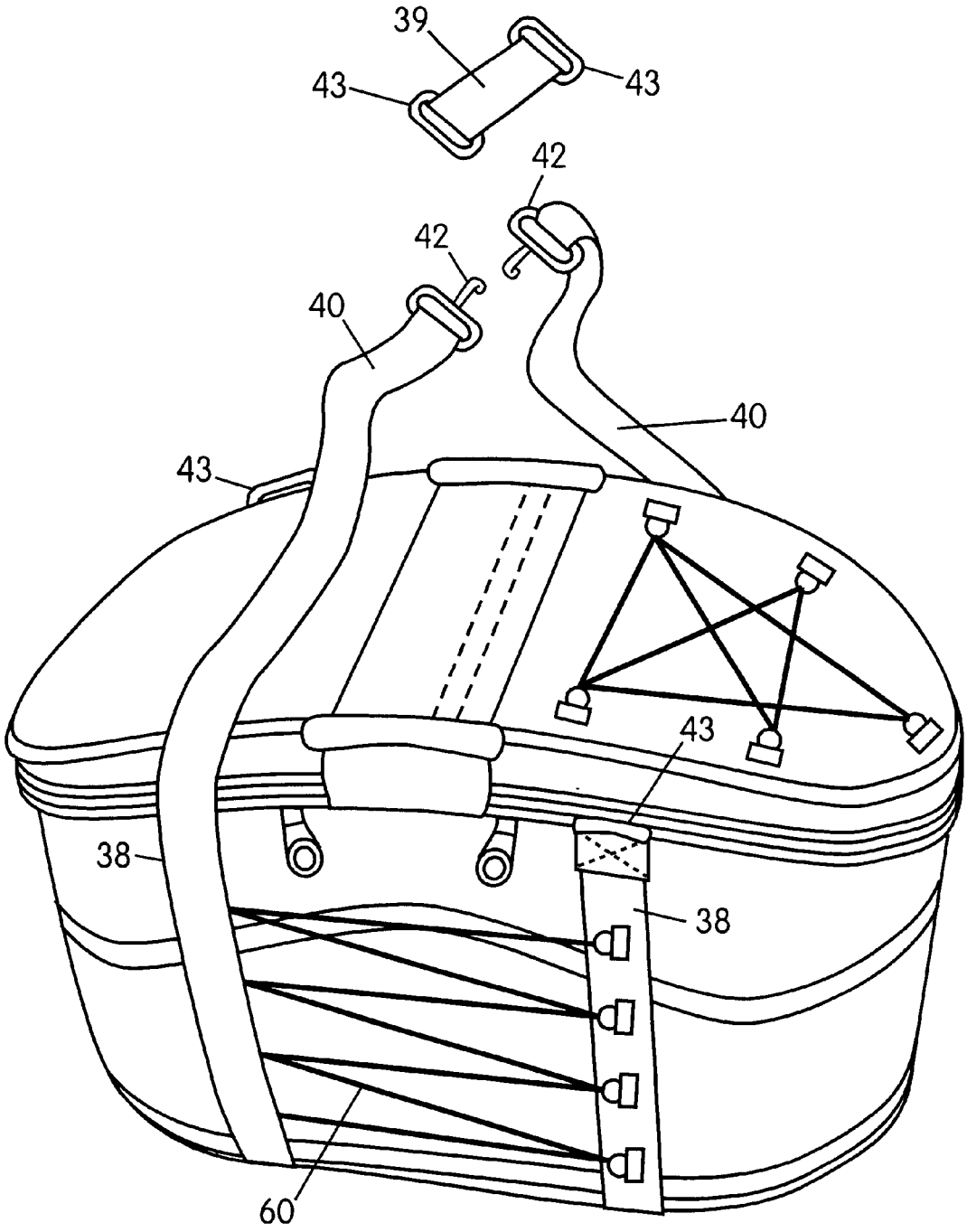
FIG. 7 is a perspective view of an exemplary tote-bag cooler according an embodiment of the present invention, including a view of adjustable carrying straps in an intermediate position, and a view of supplemental carriers.

As illustrated in FIGS. 5–7, a handle 39 may be connected to a portable cooler 100 according to an exemplary embodiment of the present invention. For example, adjustable straps 40 permit the handle 39 to move between a handbag position (see FIG. 5) and a shoulder bag position (see FIG. 7) by reconnecting the straps in a different fashion (see FIG. 6). Use of adjustable straps 40 may avoid the need to have both handle straps 29A and a separate shoulder strap 29B.

The adjustable straps 40 may be, for example, fixedly or removably attached to opposite sides of sidewall 13 of the cooler 100. A strap support 38 fixedly attached to the sidewall 13 may be used to reinforce the attachment of the straps 29A, 29B, or 40 to sidewall 13. In an alternative embodiment, a continuous strap could be used. The adjustable straps 40 removably attach to handle 39 by a locking device 41, such as, for example, ladder lock clips, hook clips, snaps, snap-locks, VELCRO®, or buckles. Adjustable hook clips 42 are shown in FIGS. 5–7. Bracketed loops 43 exist on the container 10 and at either ends of handle 39. Hook clips 42 and the attached adjustable straps 40 pass through bracketed loops 43, after which hook clips 42 curl over to clip onto rings on adjustable straps 40. For example, as shown in FIGS. 6 and 7, one end of the straps 40 may be permanently affixed to a sidewall 13 while the other end of the strap 40 may be adjustable with respect to an end of handle 39 via clip 42. Suitable materials for the adjustable straps 40 and handle 39 may include leather, vinyl, waterproof cloth or leatherette.

In a further exemplary embodiment illustrated in FIG. 7, a sidewall 13 or top side 9 of the portable cooler 100 may include a supplemental carrier 60, such as a bungee cord or other extensible cord-like material, to permit additional articles to be secured against the outer surface 2 of the top side 9 or sidewall 13. The supplemental carrier 60 may provide, for example, increased transporting capacity for items which do not require temperature control.

In a further exemplary embodiment illustrated in FIG. 6, the strap supports 38 may include folds 38A in places where the strap supports 38 are not attached to the outer surface 2 of the container 10, but ripple along the sidewall 13. Folds 38A create gaps 38B into which long, narrow items, such as serving utensils, grill or cooking utensils (such as fork 38C), or rolled place mats may be inserted. When inserted into parallelly-spaced gaps 38B on adjacent strap supports 38, the long, narrow items may be supported at both ends.

A number of embodiments of the present invention have been described above. Nevertheless, it will be understood that various modifications may be made without departing from the spirit and scope of the invention. Accordingly, other embodiments may be within the scope of the following claims. It is intended that all matter contained in the above description or shown in the accompanying drawings shall be interpreted as illustrative and not in a limiting sense. It is also understood that the following claims are intended to cover all of the generic and specific features of the invention herein described and all statements of the scope of the invention, which, as a matter of language, might be said to fall therebetween.

What is claimed is:

1. A flexible, closeable insulated container comprising:

a sidewall having a top edge and a bottom edge;

a bottom side attached to the bottom edge of the sidewall;

a top side attached to the top edge of the sidewall; and at least one strap attached to the container such that the container may be suspended by the at least one strap;

the top side including two overlapping flaps formed by a first flap and a second flap, each of the first flap and the second flap being attached to and extending inward from the top edge, the overlapping flaps creating a self-sealing, sleeve-style aperture between the first flap and the second flap, the aperture providing access to at least one chamber delimited by the sidewall, the bottom side and the top side; and, the sidewall, the bottom side and the top side each having an inner surface and an outer surface, an insulating material being disposed between the inner surface and the outer surface of each of the sidewall, the bottom side and the top side.

2. The flexible, closeable insulated container according to claim 1, further comprising at least one beverage holder movably connected to the outer surface of the closeable container, the at least one beverage holder including an upper portion having an opening through which a predetermined beverage container may be disposed, the at least one beverage holder being moveable between a closed position adjacent the outer surface and an open position extending from the outer surface, wherein when the at least one beverage holder is in the open position, the predetermined beverage container can be supported adjacent the outer surface by the at least one beverage holder.

3. The flexible, closeable insulated container according to claim 2, wherein the predetermined beverage container includes a stemware vessel having a stem, the opening of the upper portion having a slot through which the stem may be passed, the stemware vessel being supported by the upper portion while the stemware vessel traverses the opening.

4. The flexible, closeable insulated container according to claim 1, further comprising at least one vertical interior wall, and wherein the at least one chamber includes a primary chamber and at least one secondary chamber delimited by the at least one vertical interior wall, the primary chamber being enclosed by the overlapping flaps, and wherein the top side further includes additional overlapping flaps located between the top edge of the sidewall and the overlapping flaps, the additional overlapping flaps creating at least one secondary self-sealing, sleeve-style aperture providing access to the at least one secondary chamber.

5. The flexible, closeable insulated container according to claim 1, wherein the top side is attached to the top edge by a zipper assembly, wherein unzipping the zipper assembly permits the top side to open away from the top edge to provide a user access to the at least one chamber.

6. The flexible, closeable insulated container according to claim 1, further comprising at least one vertical interior wall delimiting a primary chamber and at least one secondary chamber, the primary chamber being enclosed by the overlapping flaps, wherein the top side includes at least one releasably engageable lid being located between the top edge of the sidewall and the overlapping flaps and providing a sealing connection to the at least one secondary chamber.

7. The flexible, closeable insulated container according to claim 6:

wherein the at least one secondary chamber includes two secondary chambers positioned on either side of the primary chamber, the primary chamber being centrally located between the secondary chambers;

wherein the at least one releasably engageable lid includes two lids; and wherein the sealing connection of each lid is formed by a zipper assembly divided between an exposed perimeter of each lid and an exposed corresponding perimeter of each corresponding top edge.

8. The flexible, closeable insulated container according to claim 1, further comprising one of a mesh pocket and a fabric pocket attached to the outer surface of a sidewall.

9. The flexible, closeable insulated container according to claim 8, wherein the fabric pocket includes a closure mechanism to secure an opening of the fabric pocket to the outer surface.

10. The flexible, closeable insulated container according to claim 1, further comprising a seat belt holder connected to a lower portion of the outer surface, the seat belt holder providing a releasably engageable connection between the closeable container and the seat belt of a vehicle to maintain the closeable container in an upright position.

11. The flexible, closeable insulated container according to claim 1, further comprising an outer flap having a perimeter that sealably covers the outer surface near the aperture of the overlapping flaps, the outer flap being fixedly attached to the container along a first portion of the perimeter of the outer flap;

wherein a second portion of the perimeter of the outer flap is releasably attached to a section of the outer surface near the aperture, thereby covering the aperture and creating a seal between the outer flap and the section of the outer surface near the aperture.

12. The flexible, closeable insulated container according to claim 1, wherein the at least one strap includes one of at least one handle strap and an adjustable shoulder strap.

13. The flexible, closeable insulated container according to claim 12, wherein the at least one handle strap includes two handle straps.

14. The flexible, closeable insulated container according to claim 13, wherein the two handle straps include a closeable handle grip.

15. The flexible, closeable insulated container according to claim 1, wherein the at least one strap includes a plurality of folds displaced vertically along the outer surface of the sidewall, the plurality of folds forming gaps between the outer surface and portions of the at least one strap;

wherein items to be carried may be inserted in the gaps and held against the outer surface by the plurality of folds.

16. A cooler comprising:

an closeable container having a sidewall having a top edge and a bottom edge, a bottom side sealed to the bottom edge of the sidewall, a top side attached to the top edge of the sidewall, overlapping flaps attached to and extending inward from the top side, and at least one chamber delimited by the sidewall, the top side, the bottom side, and overlapping flaps; the closeable container having an inner surface and an outer surface, an insulating material being disposed between the inner surface and the outer surface throughout the closeable container; and an adjustable handle assembly connected to the outer surface of the closeable container, the adjustable handle being adjustable between a first handbag position and a second shoulder bag position;

wherein at least one chamber is enclosed by the overlapping flaps, the overlapping flaps creating a self-sealing, sleeve-style aperture leading into at least one chamber of the container.

17. The cooler according to claim 16, wherein the adjustable handle assembly includes:

a first strap having a first end and a second end, the first end and second end connectable to the outer surface of the container respectively by a first end connection and a second end connection;

a second strap having a primary end and a secondary end, the primary end and secondary end connectable to the outer surface of the closeable container respectively by a primary end connection and a secondary end connection; and a closeable handle grip adjustably positioned along the first strap;

wherein the first strap and the second strap are in the first handbag position when the first end, the second end, the primary end, and the secondary end are connected to the outer surface of the closeable container; and wherein the closeable handle grip may wrap around the second strap and then releasably close, joining the first and second straps at a midpoint.

18. The cooler according to claim 17, wherein the first end connection, the second end connection, the primary end connection, and the secondary end connection releasably attach the first end, the second end, the primary end, and the secondary end to the outer surface of the closeable container; and wherein the second end connection may releasably interconnect with the primary end connection, thereby releasably attaching the second end to the primary end, and connecting the first strap and the second strap to form the second shoulder bag position.

19. The cooler according to claim 17, wherein the first end connection and the secondary end connection fixedly attach the first end and the secondary end to the outer surface of the closeable container, whereas the second end connection and the primary end connection releasably attach the second end and the primary end to the outer surface of the closeable container; and wherein the second end connection may releasably interconnect with the primary end connection, thereby releasably attaching the second end to the primary end, and connecting the first strap and the second strap to form the second shoulder bag position.

20. A closeable, insulated container comprising:

a sidewall having a top edge and a bottom edge;

a bottom side sealed to the bottom edge of the sidewall;

a top side attached to the top edge of the sidewall, the sidewall, bottom side and top side delimiting at least one chamber;

the top side includes two overlapping flaps, a first flap and a second flap, attached to and extending inward from the top edge;

the closeable container having an inner surface and an outer surface, an insulating material being disposed between the inner surface and the outer surface throughout the closeable container; and at least one handle attached to the container;

wherein the at least one chamber is enclosed by the two overlapping flaps, the overlapping flaps creating a self-sealing, sleeve-style aperture leading into the at least one chamber of the container.

* * * * *